US006840581B2

(12) United States Patent
Chen

(10) Patent No.: US 6,840,581 B2
(45) Date of Patent: Jan. 11, 2005

(54) HEIGHT ADJUSTMENT ARRANGEMENT FOR CHAIR HEADREST

(76) Inventor: Chun Chen, No. 32-8, Hsipu, Hsinfu Village, Hsi Kang, Tainan County (TW)

( * ) Notice: Subject to any disclaimer, the term of this patent is extended or adjusted under 35 U.S.C. 154(b) by 0 days.

(21) Appl. No.: 10/420,607

(22) Filed: Apr. 22, 2003

(65) Prior Publication Data

US 2004/0212239 A1 Oct. 28, 2004

(51) Int. Cl.[7] ..... A47C 1/10
(52) U.S. Cl. ..... 297/410; 248/118; 248/408
(58) Field of Search ..... 297/410, 396, 297/353, 61, 411.36; 248/118, 118.5, 408, 295.11

(56) References Cited

U.S. PATENT DOCUMENTS 1,196,413 A * 8/1916 Yohe ..... 297/410
3,860,286 A * 1/1975 Rasmussen ..... 297/408
4,989,836 A * 2/1991 Hudson et al. ..... 297/391
5,348,374 A * 9/1994 Kuo ..... 297/344.18
5,531,505 A * 7/1996 Baetz et al. ..... 297/408
5,713,635 A * 2/1998 De Filippo ..... 297/410
5,895,094 A * 4/1999 Mori et al. ..... 297/410
6,676,581 B1 * 1/2004 Lin ..... 482/148

* cited by examiner

*Primary Examiner*—Peter R. Brown
*Assistant Examiner*—Stephen Vu
(74) *Attorney, Agent, or Firm*—Alan D. Kamrath; Nikolai & Mersereau, P.A.

(57) ABSTRACT

A height adjustment arrangement for a headrest or the like includes a spring in a rear recess of a backrest. A T-shaped trigger member is received in the recess for biasing against the spring. A plate is secured onto the recess, with the plate having a slit. A finger tab of the trigger member projects from the horizontal slit. Two upright tubes are formed either on sides of a J-bar or on a backside of the backrest. An, inverted U-shaped rod has a top attached to the headrest or the like and two groups of notches opposite the backrest. The trigger member is locked in two notches. In operation, the finger tab is pushed to compress the spring for disengaging the trigger member from the notches. The rod can be raised or lowered relative to the trigger member until a desired height is reached. Finally, the finger tab can be released to lock the trigger member in the other notches again.

20 Claims, 7 Drawing Sheets

HEIGHT ADJUSTMENT ARRANGEMENT FOR CHAIR HEADREST

BACKGROUND OF THE INVENTION

1. Field of the Invention

The present invention relates to mechanisms for adjustably positioning components of a chair relative to one another and more particularly to an improved height adjustment arrangement for a chair headrest or the like.

2. Description of Related Art

Well known chair backrest, arm, or seat height adjustment mechanisms take various forms. Such prior mechanisms are typically complex in constructions, trouble-prone, and unreliable in use. Moreover, protruding operating handles, levers or knobs of some prior mechanisms are troublesome to manipulate, and are unsightly. Thus, the need for improvement still exists.

SUMMARY OF THE INVENTION

It is an object of the present invention to provide a height adjustment mechanism for a headrest or the like. The mechanism comprises a horizontal recess in a rear side of a backrest, the recess having a central, cylindrical hole; a resilient means element anchored in the hole; a substantially T-shaped trigger member inserted in the recess for biasing against the resilient element, the trigger member comprising a projecting finger tab; a plate releasably secured onto the recess, the plate having a central, horizontal slit, with the finger tab projecting therefrom; two upright tubes formed on two opposite sides of a vertically stationary upright backrest support which is attached to a backside of the backrest and an underside of a seat; and an inverted U-shaped rod having a top attached to the headrest or the like and two groups of a plurality of notches in a forward side facing the backrest, with one group being disposed in each vertical section of the rod, the finger tab being disposed between the vertical sections of the rod, and two spaced portions in a horizontal section of the trigger member divided by the finger tab being fastened simultaneously received in aligned notches in the vertical sections in a non-operating position. Pushing of the finger tab compresses the resilient element until the spaced portions in the horizontal section of the trigger member clear from the notches. Raising or lowering of the rod while continuously pushing the finger tab moves the rod relative to the trigger member until a desirable height of the rod is reached, and the finger tab is aligned with two other notches. Releasing of the finger tab causes the trigger member to bounce rearward for moving the spaced portions in the horizontal section of the trigger member in the other flush ones of the notches for fastening the inverted U-shaped rod again.

It is another object of the present invention to provide a height adjustment mechanism for a headrest or the like. The mechanism comprises a horizontal recess in a rear side of a backrest, the recess having a central, cylindrical hole; a resilient means element anchored in the hole; a substantially T-shaped trigger member inserted in the recess for biasing against the resilient element, the trigger member comprising a projecting finger tab; a plate releasably secured onto the recess, the plate having a central, horizontal slit with the finger tab projecting therefrom; two upright tubes formed on a backside of the backrest below the recess, with a vertically stationary upright backrest support disposed between the tubes, the vertically stationary upright backrest support having one end secured to the backside of the backrest and the other end attached to an underside of a seat; and an inverted U-shaped rod having a top attached to the headrest or the like and two groups of a plurality of notches in a forward side facing the backrest, one group being disposed in each vertical section of the rod, the finger tab being disposed between the vertical sections of the rod, and two spaced portions in a horizontal section of the trigger member divided by the finger tab being simultaneously received in aligned notches in the vertical sections in a non-operating position. Pushing of the finger tab compresses the resilient element until the spaced portions in the horizontal section of the trigger member clear from the notches. Raising or lowering of the rod while continuously pushing the finger tab moves the rod relative to the trigger member until a desirable height of the rod is reached and the finger tab is aligned with two other notches. Releasing of the finger tab causes the trigger member to bounce rearward for moving the spaced portions in the horizontal section of the trigger member in the other two notches for fastening the inverted rod again.

The above and other objects, features and advantages of the present invention will become apparent from the following detailed description taken with the accompanying drawings.

DETAILED DESCRIPTION OF THE PREFERRED EMBODIMENTS

Figure 1:
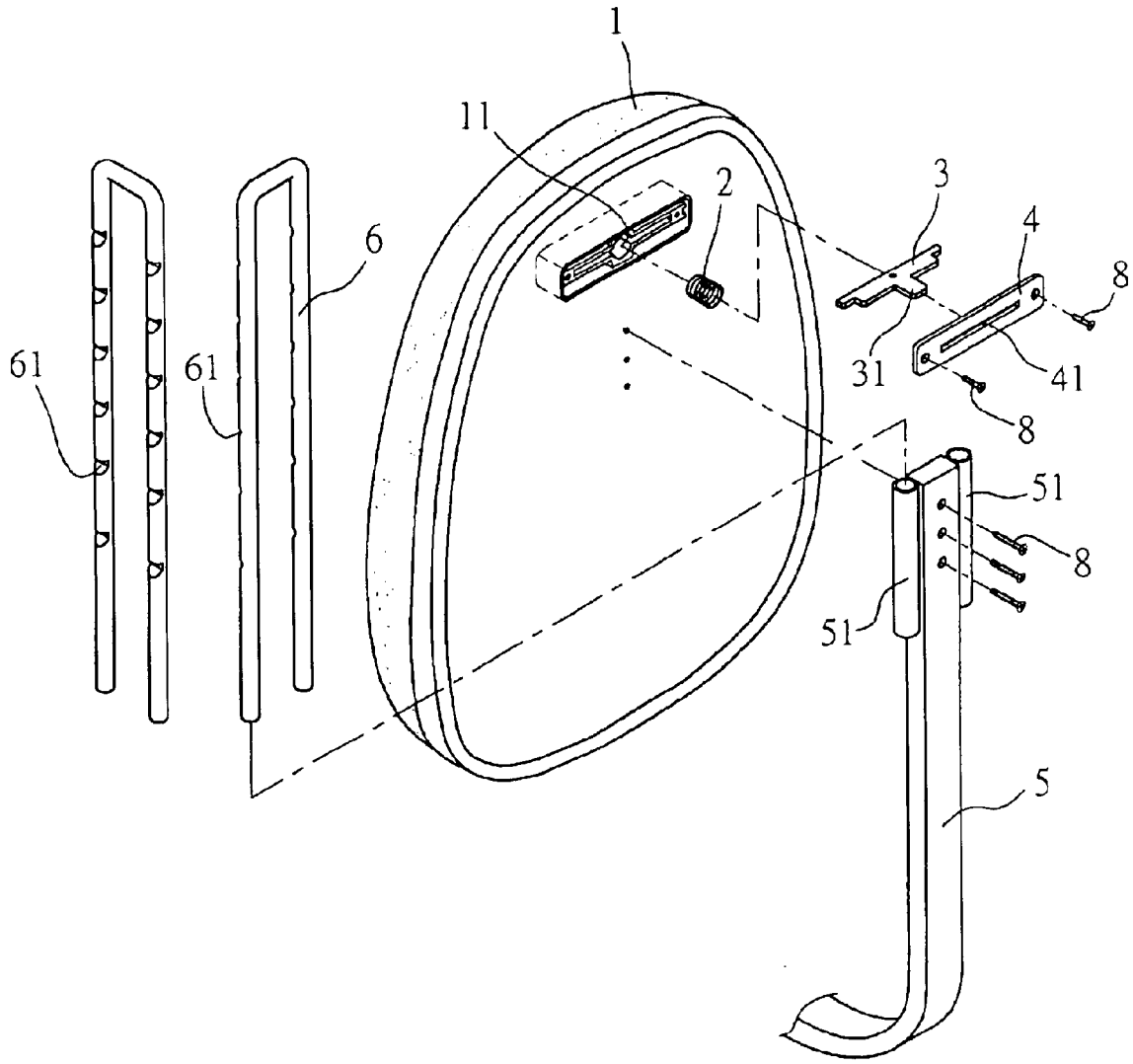
FIG. 1 is an exploded view of a first preferred embodiment of arrangement for carrying out a height adjustment of a chair headrest or the like according to the invention.
Figure 2:
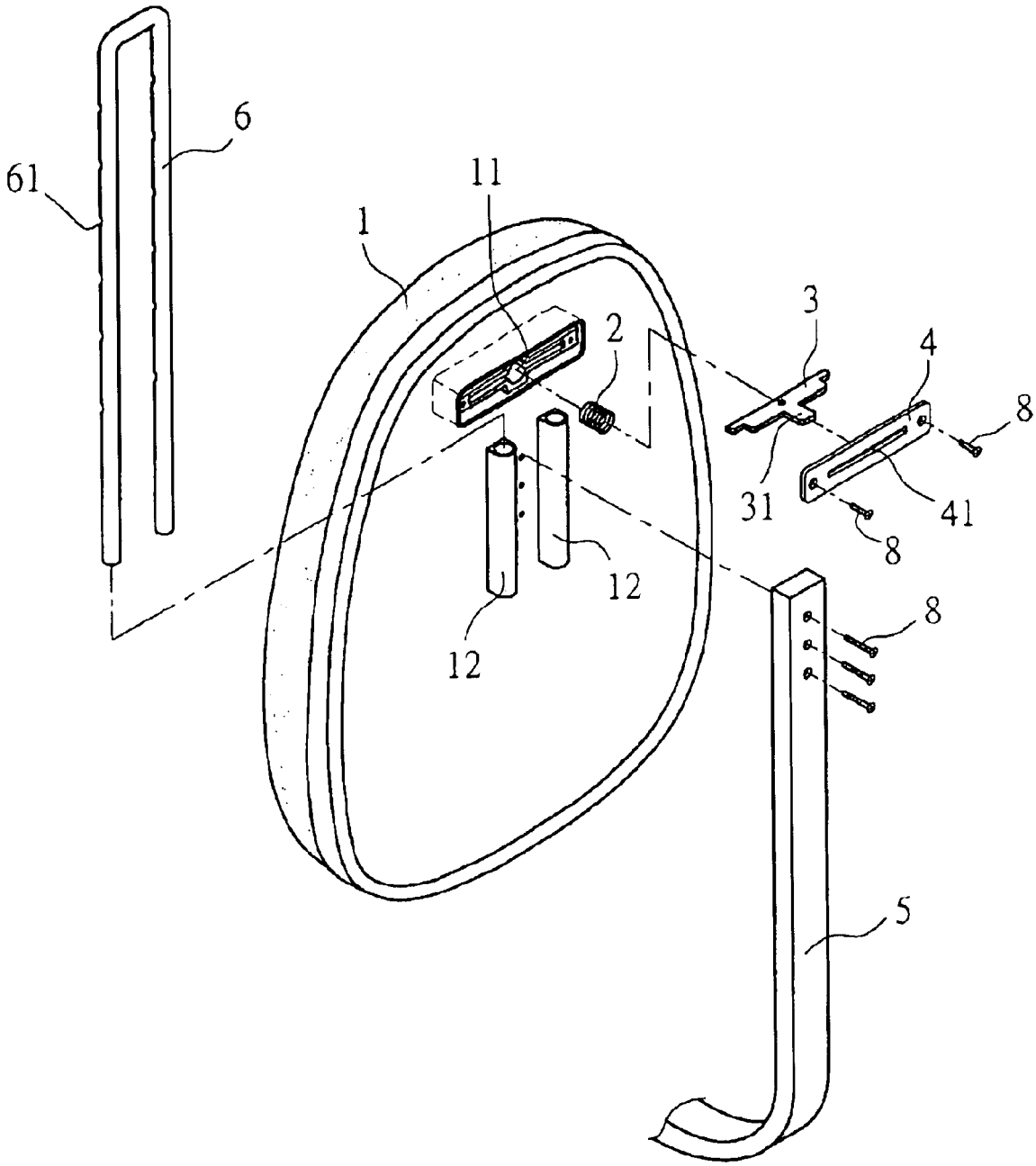
FIG. 2 is an exploded view of a second preferred embodiment of arrangement for carrying out a height adjustment of a chair headrest or the like according to the invention.
Figure 3:
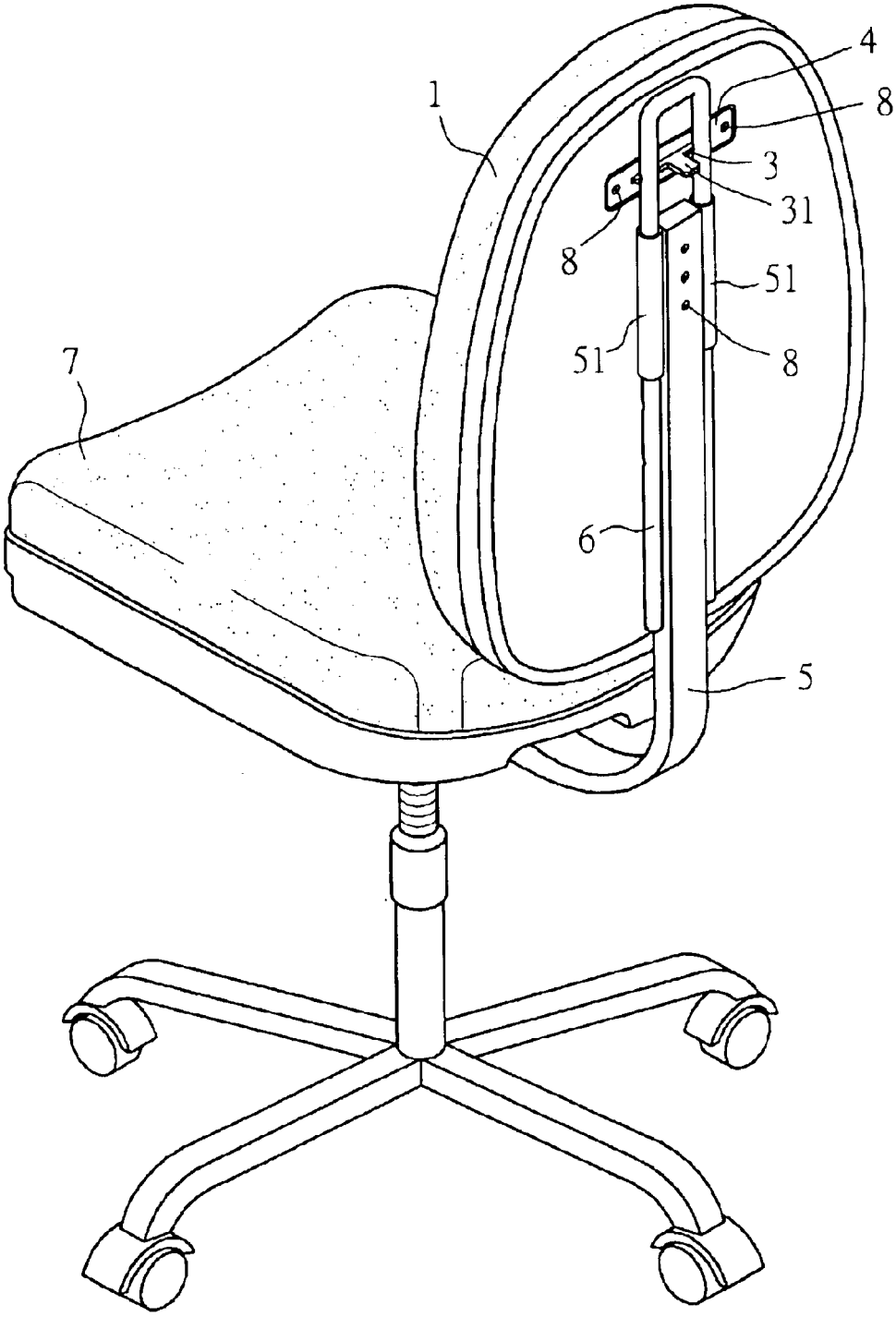
FIG. 3 is a perspective view of a chair having the first preferred embodiment of arrangement.

Referring to FIGS. 1 through 4, a chair incorporates an arrangement for adjusting height of a headrest or the like in accordance with the invention. The arrangement comprises a horizontal recess 11 in a rear side of a backrest 1. A spring 2 is anchored in a central, cylindrical hole of the recess 11. A substantially T-shaped trigger member 3 is inserted in the recess 11 for biasing against the spring 2. A rectangular plate 4 is threadedly secured onto the recess 11 by means of two fasteners (e.g., screws) 8, with the plate 4 having a central, horizontal slit 41. A finger tab 31 of the trigger member 3 projects from the central, horizontal slit 41. First and second upright tubes 51 are formed on opposite sides of a vertically stationary upright backrest support (or J-bar) 5 (as in a first preferred embodiment of FIG. 1), or two upright tubes 12 are formed on the backside of the backrest 1 below the recess 11 at a predetermined distance (as in a second preferred embodiment of FIG. 2). The J-bar 5 has an upper end threadedly secured to the backside of the backrest 1 by means of a plurality of fasteners (e.g., screws) 8 and a lower end attached to the underside of a seat 7. The arrangement further comprises an inverted U-shaped rod 6 having two groups of a plurality of notches 61 in a forward side facing the backrest 1, with one group being disposed in each of two vertical sections of the rod 6. Each notch 61 an upper, horizontal end as a stop and a lower, inclined surface for facilitating a longitudinal motion of the backrest 1 relative to the rod 6. The finger tab 31 is disposed between the vertical sections of the rod 6. Two spaced portions in a horizontal section of the trigger member 3 divided be the finger tab 31 are simultaneously received in two aligned notches 61.

Figure 4:
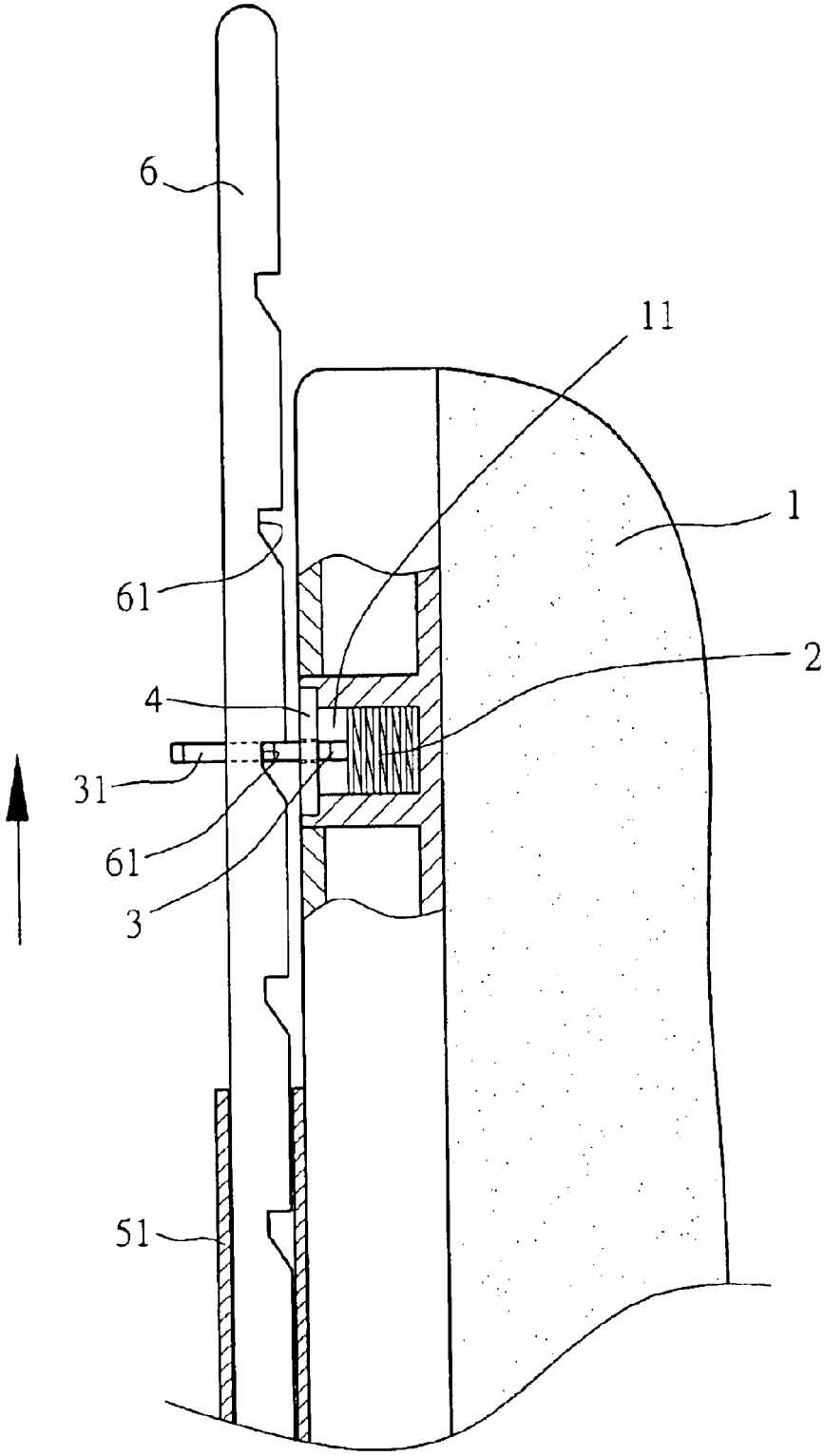
FIG. 4 is a sectional view of the arrangement of FIG. 1 mounted in a rear side of the backrest where a rod is locked.
Figure 5:
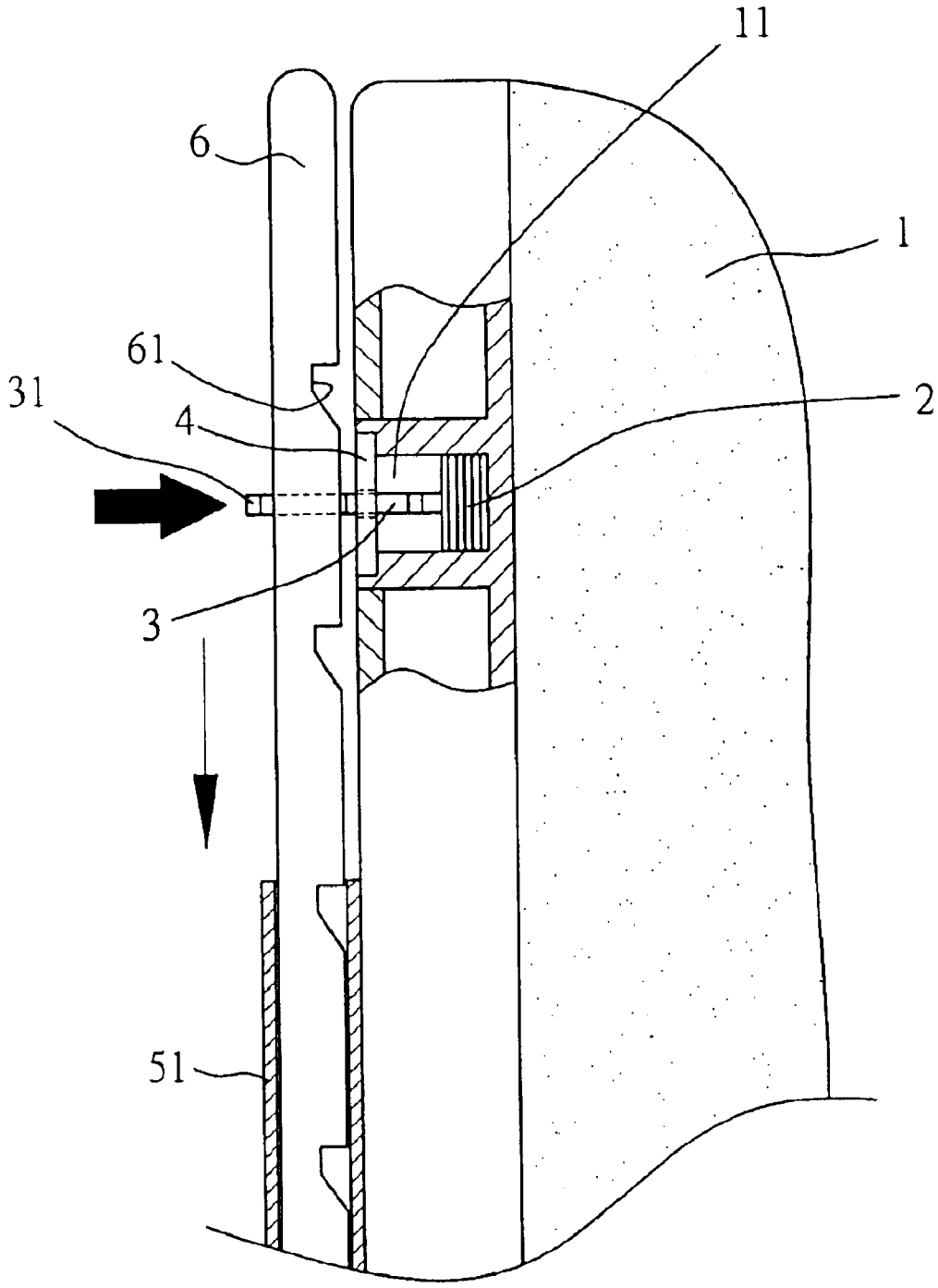
FIG. 5 is a view similar to FIG. 4 where the rod is unlocked for being lowered.

Referring to FIG. 5 in conjunction with FIG. 4, a height adjustment of the rod 6 relative to the backrest 1 by operating the arrangement will be described below. In a non-operating position as shown in FIG. 4, the spring 2 is fully expanded to push the trigger member 3 outward so as to fasten the two spaced portions in the horizontal section of the trigger member 3 in two notches 61. At this position, the trigger member 3 is locked, i.e., the trigger member 3 is stopped by the upper, horizontal ends of the notches 61. For either raising or lowering the rod 6 relative to the backrest 1 (see FIG. 5), a user has to push the finger tab 31 for sliding the finger tab 31 a predetermined distance and compressing the spring 2 until the spaced portions in the horizontal section of the trigger member 3 clear from the notches 61 for ensuring that there is no interference from the trigger member 3 in a next downward movement of the rod 6. The user then pushes the rod 6 down by one hand while continuously pushing the finger tab 31 by the other hand until a desired height is reached and the finger tab 31 is aligned with two other notches 61. Immediately, the user can release the finger tab 31 to cause the trigger member 3 to bounce rearward for moving the two spaced portions in the horizontal section of the trigger member 3 in the notches 61 for fastening the rod 6 to the backrest 1 again.

Figure 6:
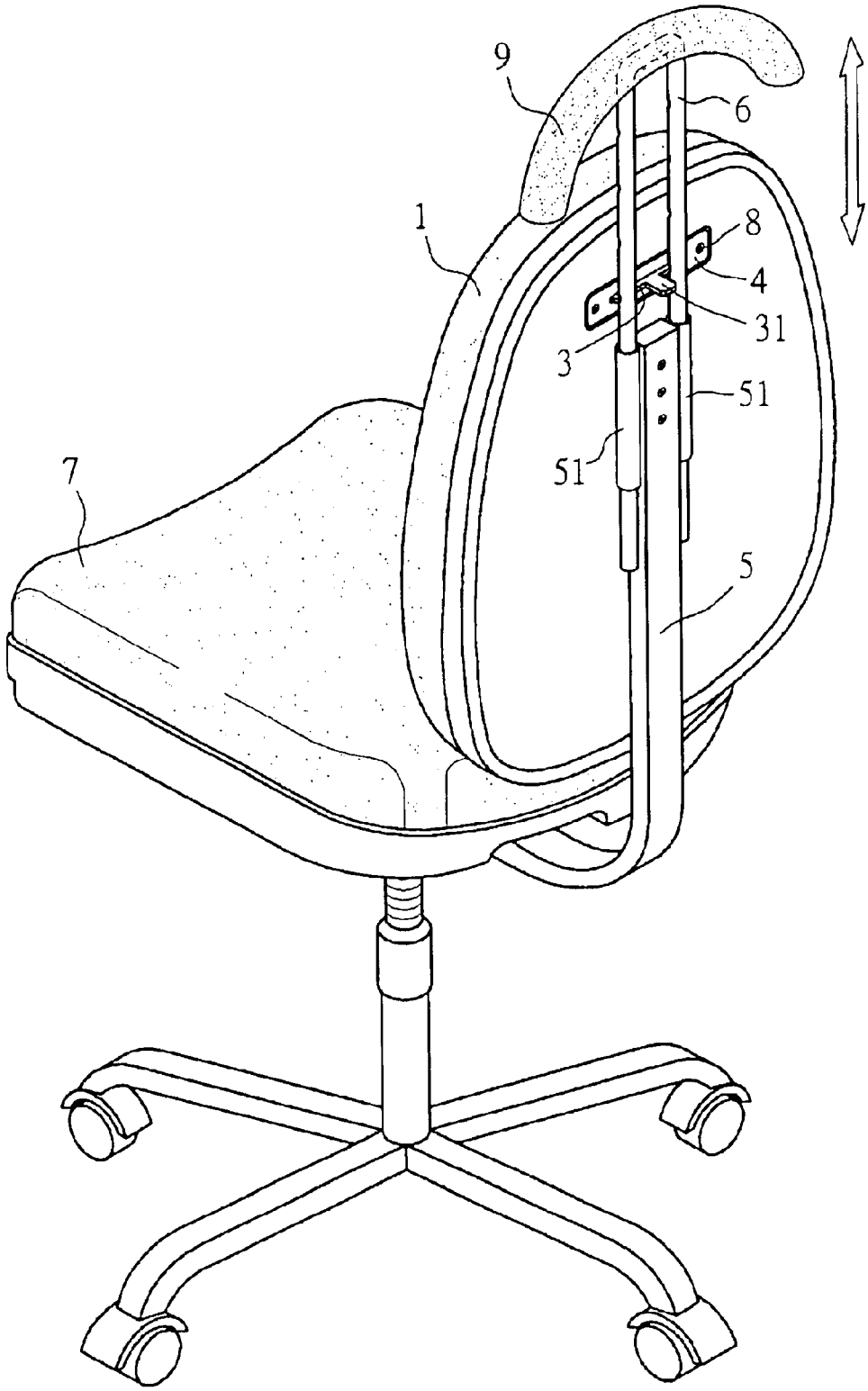
FIG. 6 is a perspective view of a chair having the first or second preferred embodiment of arrangement with a hanger mounted on top of the rod in one configuration according to the invention.
Figure 7:
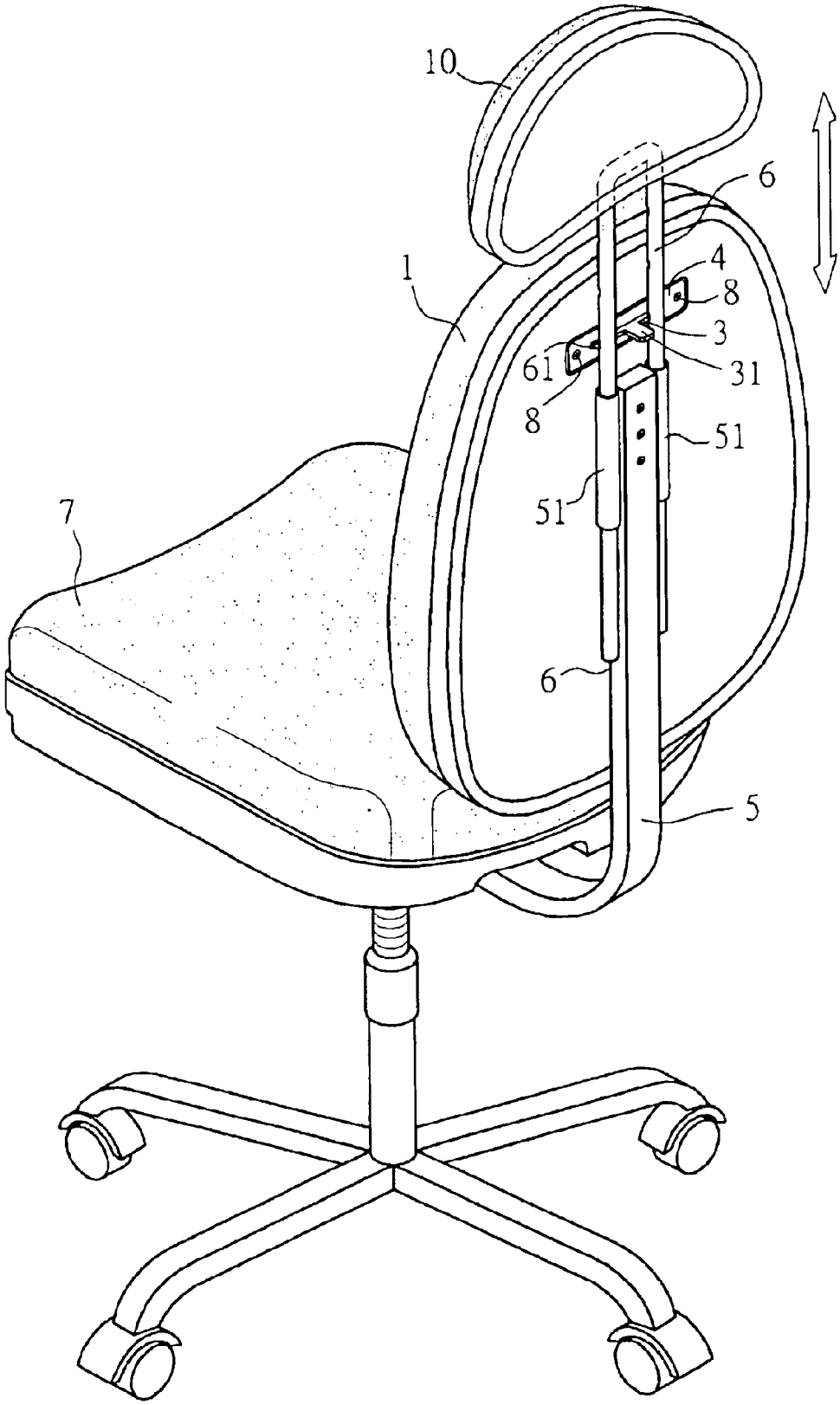
FIG. 7 is a view similar to FIG. 6 where a headrest is mounted on top of the rod in another configuration according to the invention.

Referring to FIGS. 6 and 7, in other embodiments a hanger 9 (see FIG. 6) or a headrest 10 (see FIG. 7) is mounted on top of the rod 6 so that a user can adjust the height of the hanger 9 or the headrest 10 relative to the backrest 1 for achieving the purpose of personal comfort or the like.

While the invention herein disclosed has been described by means of specific embodiments, numerous modifications and variations could be made thereto by those skilled in the art without departing from the scope and spirit of the invention set forth in the claims.

What is claimed is:

1. A height adjustment mechanism mounted in a chair, comprising:

a horizontal recess in a rear side of a backrest, the recess having a central, cylindrical hole;

a resilient element anchored in the hole;

a substantially T-shaped trigger member inserted in the recess for biasing against the resilient element, the trigger member comprising a horizontal section having a projecting finger tab located between two spaced portions;

a plate releasably secured onto the recess, the plate having a central, horizontal slit, with the finger tab and the two spaced portions of the trigger member through the horizontal slit;

two upright tubes on opposite sides of a vertically stationary upright backrest support which is attached to a backside of the backrest and an underside of a seat, with the two upright tubes being below the recess;

an inverted U-shaped rod having two vertical rods, with each of said vertical rods including a plurality of notches in a forward side facing the backrest, the finger tab being disposed between the vertical sections of the rod, and with the two spaced portions in the horizontal section of the trigger member being simultaneously received in two notches in a non-operating position; and a predetermined member mounted on a top of the rod, wherein pushing of the finger tab moves the T-shaped trigger member into the recess towards the backrest and compresses the resilient element until the spaced portions in the horizontal section of the trigger member clear from the notches, raising or lowering of the rod while continuously pushing the finger tab moves the rod relative to the trigger member until a desirable height of the rod is reached and the finger tab is aligned with two other notches, and releasing of the finger tab causes the trigger member to bounce rearward for moving the spaced portions in the horizontal section of the trigger member in the two other notches for fastening the inverted U-shaped rod to the backrest again.

2. The height adjustment mechanism of claim 1, wherein each of the notches has an upper, horizontal end and a lower, inclined surface.

3. The height adjustment mechanism of claim 1, wherein the predetermined member is a headrest.

4. The height adjustment mechanism of claim 1, wherein the predetermined member is a hanger.

5. The height adjustment mechanism of claim 1, wherein the horizontal section of the trigger member has a length beyond each of the two spaced portions and greater than the central, horizontal slit for abutting with the plate on opposite sides of the horizontal slit when biased by resilient member and the finger tab is not pushed.

6. The height adjustment mechanism of claim 1 with the resilient element being a coil spring aligned with projecting finger tab.

7. The height adjustment mechanism of claim 1 with the plate removably secured onto recess by threaded fasteners.

8. The height adjustment mechanism of claim 7 with the plate closing the recess to define a chamber receiving the resilient element and the trigger member.

9. The height adjustment mechanism of claim 1 with the plate closing the recess to define a chamber receiving the resilient element and the trigger member.

10. A height adjustment mechanism mounted in a chair, comprising:

a horizontal recess in a rear side of a backrest, the recess having a central, cylindrical hole;

a resilient element anchored in the hole;

a substantially T-shaped trigger member inserted in the recess for biasing against the resilient element, the trigger member comprising a projecting finger tab;

a plate releasably secured onto the recess, the plate having a central, horizontal slit with the finger tab projecting from the central, horizontal slit;

two upright tubes formed on a backside of the backrest below the recess with a vertically stationary upright backrest support disposed between the tubes, the vertically stationary upright backrest support having one end secured to the backside of the backrest and the other end attached to an underside of a seat;

an inverted U-shaped rod having two vertical rods, with each of said vertical rods including a plurality of notches in a forward side facing the backrest, the finger tab being disposed between the vertical sections of the rod, and with the two spaced portions in the horizontal section of the trigger member being simultaneously received in two notches in a non-operating position; and a predetermined member mounted on a top of the rod, wherein pushing of the finger tab compresses the resilient means until the spaced portions in the horizontal section of the trigger member clear from the notches, raising or lowering of the rod while continuously pushing the finger tab moves the rod relative to the trigger member until a desired height of the rod is reached and the finger tab is aligned with two other notches, and releasing of the finger tab causes the trigger member to bounce rearward for moving the spaced portions in the horizontal section of the trigger member in the other two notches for fastening the inverted U-shaped rod to the backrest again.

11. The height adjustment mechanism of claim 10, wherein each of the notches has an upper, horizontal end and a lower, inclined surface.

12. The height adjustment mechanism of claim 10, wherein the predetermined member is a headrest.

13. The height adjustment mechanism of claim 10, wherein the predetermined member is a hanger.

14. The height adjustment mechanism of claim 10, wherein the horizontal section of the trigger member has a length beyond each of the two spaced portions and greater than the central, horizontal slit for abutting with the plate on opposite sides of the horizontal slit when biased by the resilient member and the finger tab is not pushed.

15. The height adjustment mechanism of claim 14 with the resilient element being a coil spring aligned with projecting finger tab.

16. The height adjustment mechanism of claim 15 with the plate removably secured onto the recess by threaded fasteners.

17. The height adjustment mechanism of claim 16 with the plate closing the recess to define a chamber receiving the resilient element and the trigger member.

18. The height adjustment mechanism of claim 10 with the resilient element being a coil spring aligned with projecting finger tab.

19. The height adjustment mechanism of claim 10 with the plate removably secured onto the recess by threaded fasteners.

20. The height adjustment mechanism of claim 10 with the plate closing the recess to define a chamber receiving the resilient element and the trigger member.

* * * * *